US008086158B2

(12) United States Patent
Domoto et al.

(10) Patent No.: US 8,086,158 B2
(45) Date of Patent: Dec. 27, 2011

(54) METHOD AND APPARATUS FOR ENHANCED SHEET STRIPPING

(75) Inventors: Gerald A Domoto, Briarcliff Manor, NY (US); Elias Panides, Whitestone, NY (US); Ruddy Castillo, Bronx, NY (US); Bryan J Roof, Newark, NY (US); William A Burton, Rochester, NY (US); Steven M Russel, East Bloomfield, NY (US); Donald M Bott, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1206 days.

(21) Appl. No.: 11/769,225

(22) Filed: Jun. 27, 2007

(65) Prior Publication Data

US 2009/0003896 A1 Jan. 1, 2009

(51) Int. Cl.
*G03G 15/20* (2006.01)

(52) U.S. Cl. ..... 399/323; 399/332; 399/337; 399/390; 399/400; 399/406

(58) Field of Classification Search ..... 399/323, 399/315, 332, 337, 390, 400, 406
See application file for complete search history.

(56) References Cited

U.S. PATENT DOCUMENTS

| | | | | |
|---|---|---|---|---|
| 4,475,896 | A | 10/1984 | Bains | |
| 4,505,695 | A * | 3/1985 | Billings | 493/459 |
| 4,591,259 | A * | 5/1986 | Kuo et al. | 399/406 |
| 4,632,533 | A | 12/1986 | Young | |
| 4,876,576 | A | 10/1989 | Itaya et al. | |
| 4,926,358 | A * | 5/1990 | Tani et al. | 700/302 |
| 5,059,988 | A * | 10/1991 | Hisada | 346/134 |
| 5,123,895 | A | 6/1992 | Mandel | |
| 5,153,662 | A | 10/1992 | Foos | |
| 5,201,514 | A | 4/1993 | Rebres | |

(Continued)

FOREIGN PATENT DOCUMENTS

JP 57111550 A * 7/1982

(Continued)

OTHER PUBLICATIONS

English translation of Japanese reference, Yamada (JP 57-111550A).*

(Continued)

*Primary Examiner* — David Gray
*Assistant Examiner* — Geoffrey Evans
(74) *Attorney, Agent, or Firm* — Richard A. Castellano; PRASS LLP

(57) ABSTRACT

An enhanced sheet stripping method and apparatus for stripping toner image carrying copy sheets from a surface of a moving heated fusing member forming a fusing nip. The apparatus includes (a) a moving assembly for moving a cut sheet towards the fusing nip; (b) a sheet curling device positioned upstream of the fusing nip relative to movement of the cut sheet for inducing a desired pre-curl in the cut sheet before the cut sheet enters the fusing nip; and (c) a sheet stripping device positioned downstream of the fusing nip for stripping the cut sheet from contact with the surface of the moving heated fusing member as the cut sheet exits the fusing nip. The method includes inducing a desired curl in the cut sheet before the cut sheet enters the fusing nip and enhanced stripping the cut sheet from contact with the surface of the fuser roll as the cut sheet exits the fusing nip.

20 Claims, 6 Drawing Sheets

U.S. PATENT DOCUMENTS

| | | | | |
|---|---|---|---|---|
| 5,337,128 | A * | 8/1994 | Hashizume et al. | 399/314 |
| 5,572,308 | A * | 11/1996 | Suda et al. | 399/401 |
| 5,617,193 | A * | 4/1997 | Ban et al. | 399/316 |
| 5,787,330 | A * | 7/1998 | Funato | 399/390 |
| 5,812,923 | A * | 9/1998 | Yamauchi et al. | 399/388 |
| 5,933,697 | A * | 8/1999 | Onodera et al. | 399/406 |
| 6,112,048 | A * | 8/2000 | Westhoff | 399/406 |
| 6,185,403 | B1 * | 2/2001 | Toyoshima et al. | 399/365 |
| 6,189,173 | B1 * | 2/2001 | Saito et al. | 15/3 |
| 6,661,994 | B2 * | 12/2003 | Ohuchi et al. | 399/400 |
| 7,280,798 | B2 * | 10/2007 | Yuminamochi | 399/390 |
| 7,941,086 | B2 * | 5/2011 | Kurita | 399/341 |
| 2003/0016971 | A1 * | 1/2003 | Kikuchi et al. | 399/323 |
| 2003/0039491 | A1 * | 2/2003 | Bogoshian | 399/323 |
| 2004/0120735 | A1 * | 6/2004 | Baba et al. | 399/323 |
| 2004/0156659 | A1 * | 8/2004 | Ando et al. | 399/323 |
| 2006/0291917 | A1 * | 12/2006 | Fujisawa et al. | 399/323 |
| 2007/0059058 | A1 * | 3/2007 | Ito et al. | 399/323 |
| 2007/0140752 | A1 * | 6/2007 | Yamamoto et al. | 399/323 |
| 2007/0147911 | A1 * | 6/2007 | Hirota | 399/322 |
| 2007/0172278 | A1 * | 7/2007 | Yamamoto | 399/405 |
| 2007/0212131 | A1 * | 9/2007 | Nakayama | 399/323 |
| 2007/0223975 | A1 * | 9/2007 | Yoshida | 399/323 |
| 2009/0154976 | A1 * | 6/2009 | Castillo et al. | 399/406 |
| 2011/0142517 | A1 * | 6/2011 | Kanai et al. | 399/406 |

FOREIGN PATENT DOCUMENTS

| | | | |
|---|---|---|---|
| JP | 09152802 | A * | 6/1997 |

OTHER PUBLICATIONS

English machine translation of Japanese reference, Suzuki (JP 09-152802 A).*

* cited by examiner

METHOD AND APPARATUS FOR ENHANCED SHEET STRIPPING

The present invention relates to image producing machines that include a fusing apparatus such as solid inkjet printing machines and electrostatographic image producing machines and, more particularly, to such a machine including a method and apparatus for enhanced sheet stripping from the fusing apparatus.

BACKGROUND

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as a sheet of paper, and the surface of the photoreceptor is cleaned and prepared to be used once again for the reproduction of a copy of an original. The sheet of paper with the powdered toner thereon in imagewise configuration is separated from the photoreceptor and moved through a fusing apparatus including a heated fusing member where the toner image thereon is heated and permanently fixed or fused to the sheet of paper.

As is well known, after the toner image is fixed or fused as such, the sheet carrying the fused image must be carefully stripped from the heated fusing member (without damaging the surface of the heated fusing member) for feeding to a subsequent processing station, such as an inverter, collator, stapler, or booklet maker. It is known to use solid rigid fingers alone that either slide away from the surface of the heated fusing member or include expensive articulating assemblies for attempting to avoid damaging the surface of the heated fusing member. Additionally, it also known to use a sufficiently high pressure and high volume of compressed air in the form of an air knife either alone or in combination, to attempt to strip the sheet of paper from the surface of the heated fusing member without damaging it.

In solid inkjet color image printing, multi-colored images are formed on an intermediate member such as a drum, using different colored crayon-like inks that are solid at room temperature but are melted and image-wise applied to the intermediate member using moving printheads. Special ink formulations have been developed that allow the ink to melt at very precise temperatures, and that solidify very quickly when their temperature drops below such melting temperature. In a solid inkjet printer, the image-wise pattern of solid ink on the intermediate member is then transferred and fused or transfused onto a copy sheet. The fusing or transfusing smoothens out the sheet surface and strengthens the bond between the ink and the sheet.

Prior art that may be relevant in reviewing the patentability of the present disclosure include for example U.S. Pat. No. 4,475,896 issued Oct. 9, 1984 to Bains and entitled "Curling/decurling method and mechanism" discloses a sheet curling/decurling mechanism is disclosed as having a compliant roller with a soft, pliable material therearound, a curling roller forming a penetration nip with the compliant roller, the penetration nip being adapted to curl sheets of paper passing through the nip, and movable plates arranged adjacent the sheet exiting side of the nip for controlling the angle of exiting of the sheets from the nip.

U.S. Pat. No. 4,876,576 issued Oct. 24, 1989 to Itaya et al. and entitled "Device for changing sheet shape before entry into fuser nip" discloses a fixing device is provided in an image forming apparatus. The fixing device has first and second rollers to form a nip portion therebetween. An image forming medium having a flat shape and a leading edge, on which an unfixed image is formed. The image forming medium is conveyed and approaches the nip portion between the first and second rollers. The fixing device also has a changing unit for changing the shape of the vicinity of the leading edge of the image forming medium from the flat shape to a convex shape while the image forming medium is being conveyed to approach the nip portion.

U.S. Pat. No. 4,632,533 issued Dec. 30, 1986 to Young and entitled "Off-set nip roll decurler" discloses an apparatus in which sheet material is decurled. The apparatus includes off-set nips for reverse bending a sheet. As the sheet leaves a fuser, it is directed into one of two channels toward an off-set nip depending on the curl in the sheet. The off-set nip in conjunction with an output baffle reverse bends the sheet.

U.S. Pat. No. 5,123,895 issued Jun. 23, 1992 to Mandel and entitled "Passive, intelligent, sheet decurling system" discloses an apparatus in which sheet material is decurled. The apparatus includes a baffle type decurler in which a sheet moving therethrough chooses one of three paths and baffles, depending on the direction and amount of curl. Triangular shaped baffles prevent sheet stubbing and a decurling system reverse bends the sheets in two of the three paths.

U.S. Pat. No. 5,153,662 issued Oct. 6, 1992 to Foos and entitled "Sheet decurling apparatus" discloses an apparatus for decurling an advancing sheet is disclosed. The apparatus includes a first belt and a second belt spaced apart from the first belt so as to define a space adapted to receive the advancing sheet. The apparatus further includes a roller positioned between the first belt and the second belt, the roller being in contact with the first belt in a first mode of operation so as to define a first nip and being in contact with the second belt in a second mode of operation so as to define a second nip.

U.S. Pat. No. 5,201,514 issued Apr. 13, 1993 to Rebres and entitled "Apparatus for decurling a sheet" discloses an apparatus for decurling a sheet is disclosed. The apparatus includes a decurler shaft and a first belt positionable to contact an arcuate portion of the decurler shaft. The apparatus further includes a second belt positionable to contact the first belt and to bend around the arcuate portion of the decurler shaft. Moreover, the apparatus includes a mechanism for advancing the sheet between the first belt and the second belt so as to bend the sheet around the arcuate portion of the decurler shaft.

SUMMARY

Unfortunately, conventional rigid stripper fingers have a tendency for attracting toner particles that had just been heated and melted within the fusing nip, but now starting to cool, which then buildup on and contaminate the stripper fingers. This is a problem and can be critical in that it affects both (a) subsequent copy quality (when toner contamination from the fingers dislodge and get on or smudge a subsequent copy) and (b) stripping reliability (when toner contamination n the fingers interferes with the controlled contact with the fuser roller by lifting the a finger off the fuser roll usually causing jams and resulting in costly unscheduled maintenance calls. High pressure, high volume air knives besides being costly, are undesirable because they are near un-fused toner images within the machine.

In accordance with the present disclosure, there has been provided an enhanced sheet stripping method and apparatus for stripping toner image carrying copy sheets from a surface of a moving heated fusing member forming a fusing nip. The apparatus includes (a) a moving assembly for moving a cut sheet towards the fusing nip; (b) a sheet curling device positioned upstream of the fusing nip relative to movement of the cut sheet for inducing a desired pre-curl in the cut sheet before the cut sheet enters the fusing nip; and (c) a sheet stripping device positioned downstream of the fusing nip for stripping the cut sheet from contact with the surface of the moving heated fusing member as the cut sheet exits the fusing nip. The method includes inducing a desired curl in the cut sheet before the cut sheet enters the fusing nip and enhanced stripping the cut sheet from contact with the surface of the fuser roll as the cut sheet exits the fusing nip.

DETAILED DESCRIPTION

Figure 1:
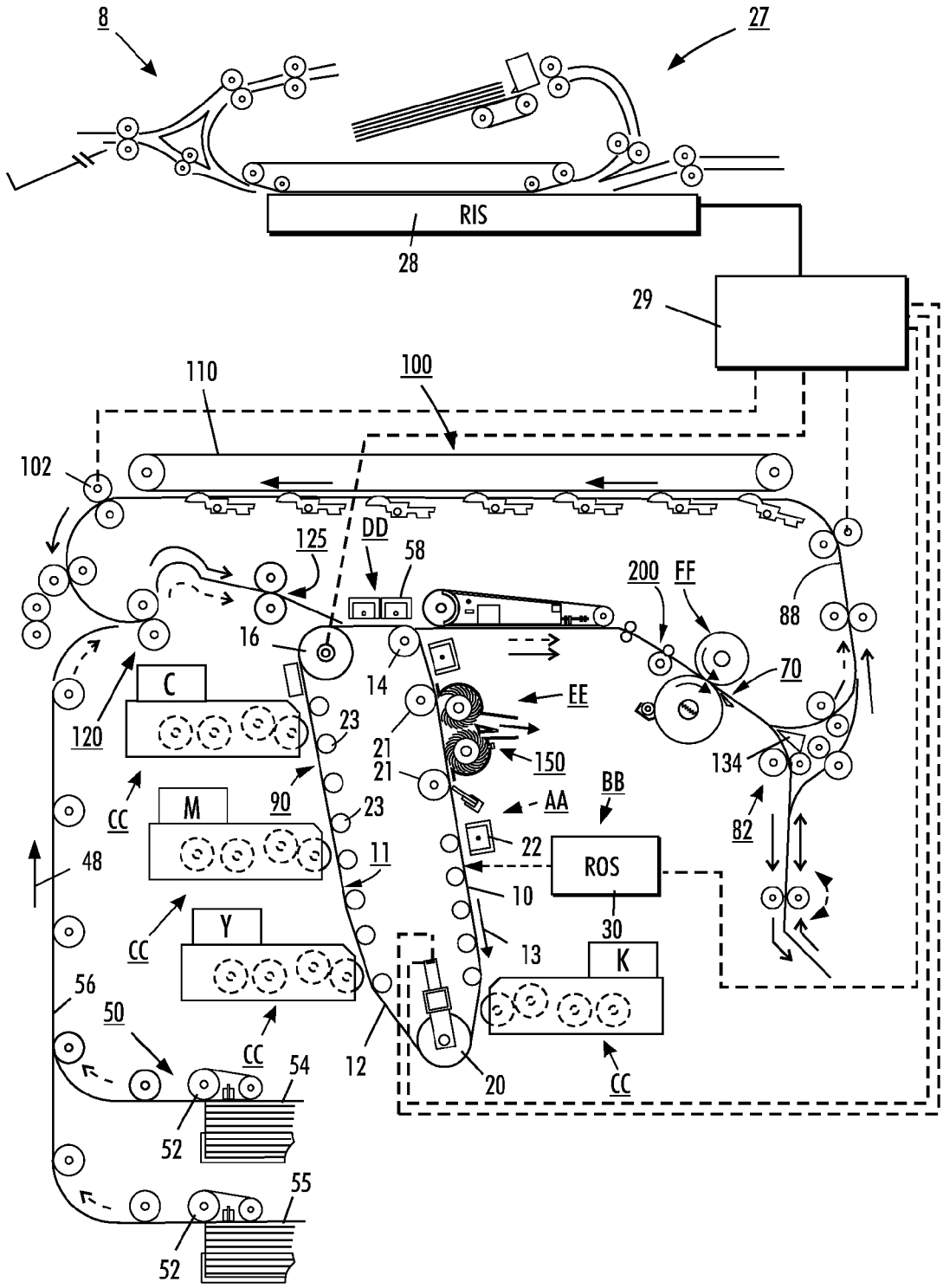
FIG. 1 is a schematic elevational view of an exemplary electrostatographic reproduction machine including a fusing apparatus including enhanced sheet stripping apparatus in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown, the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

As described above, in solid inkjet color image printing, multi-colored images are formed on an intermediate member such as a drum, using different colored crayon-like inks that are solid at room temperature but are melted and image-wise applied to the intermediate member using moving printheads. Special ink formulations have been developed that allow the ink to melt at very precise temperatures, and that solidify very quickly when their temperature drops below such melting temperature. In the solid inkjet printer, the image-wise pattern of solid ink on the intermediate member is then transferred and fused or transfused onto a copy sheet at a fusing or transfusing station such as FF.

Fusing station FF includes the fusing apparatus of the present disclosure that is indicated generally by the reference numeral 70 for fusing and permanently affixing the transferred toner powder image 213 to the copy sheet 48. Preferably, fusing apparatus 70 includes a heated fuser roller 72 having a surface 76, and a pressure roller 74, that together form a fusing nip 75 through which the sheet 48 is passed with the powder image 213 on the copy sheet 48 contacting fuser roller 72. The pressure roller 74 is loaded against the fuser roller 72 forming the fusing nip 75 for providing the necessary pressure to fix the heated toner powder image 213 to the copy sheet. The fuser roll 72 for example is internally heated by a quartz lamp 71. The fuser roll surface 76 may be cleaned by a roll 77, and release agent, stored in a reservoir (not shown), may be pumped to a metering roll 79 for application to the surface of the fuser roll after the sheet is stripped from such surface by the enhanced sheet stripping apparatus 200 of the present disclosure, (to be described in more detail below).

After that, the sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Referring now to FIGS. 1-8, the fusing apparatus 70 includes the enhanced sheet stripping apparatus 200 for stripping toner image carrying copy sheets 48 from a surface 76 of the moving heated fusing member or fuser roller 72. As illustrated, the enhanced sheet stripping apparatus 200 includes (a) a sheet moving assembly 210 for moving a cut sheet 48 in the direction of arrow 212 towards the fusing nip 75; (b) a sheet curling device 220 positioned upstream of the fusing nip 75 relative to movement 212 of the cut sheet for inducing a desired pre-curl C3 in the cut sheet before the cut sheet enters the fusing nip; and (c) a sheet stripping device 230 positioned downstream of the fusing nip for stripping the cut sheet from contact with the surface 76 of the moving heated fusing member as the cut sheet exits the fusing nip.

Figure 2A:
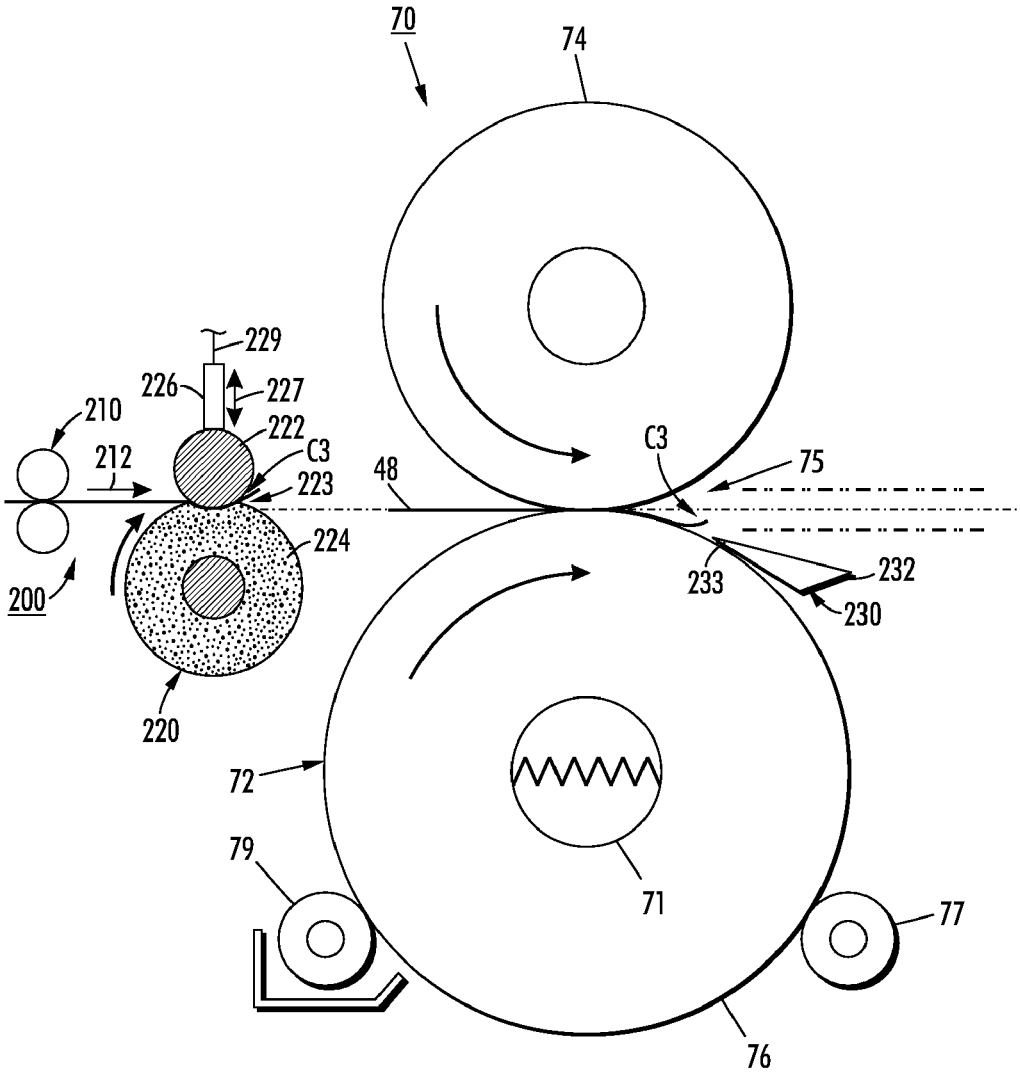
FIG. 2A is an enlarged end section schematic of the fusing apparatus of FIG. 1 showing a first embodiment of the enhanced sheet stripping apparatus in accordance with the present disclosure.
Figure 2B:
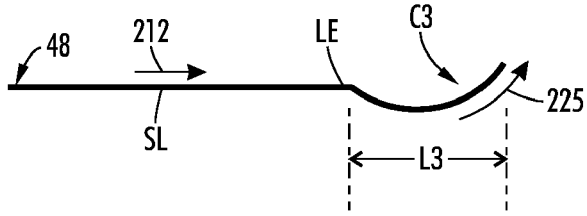
FIG. 2B is a schematic of a cut sheet pre-curled in accordance with the present disclosure.

The sheet curling device 220 includes means such as rollers 222, 224 for inducing into the cut sheet 48 the curl C3 tending away as shown by the arrow 225 in FIG. 2B. The curl C3 curled as such will cause the very edge of the lead edge LE to be pointing away from the surface 76 of the moving heated fusing member 72. The curling device 220 used in the novel manner here in a pre-fusing nip location can comprise any suitable curling/decurling assembly as are known in the art, and for example can comprise a standard roll decurler as shown including a hard roller 222 and soft roller 224 forming a curling nip 223. In this application, the soft roller 224 is located to the same side of the sheet 48 as the heated fuser roller 72, and the hard roller 222 is located on the opposite side as shown. In operation, with the lead edge LE of the sheet 48 entering the curling nip 223, moving the hard roller 222 into the soft roller 224 will start to induce the away curl C3 into the sheet 48 starting from such lead edge LE. The sheet curling device 220 also includes control means 226 connected at 229 to the machine control 29 that can be turned on and off, and/or moved in and out as shown by the arrows 227, for inducing the curl C3 starting from a lead edge LE of the cut sheet 48, and extending only a relatively short distance L3 back into the cut sheet 48. The relatively short distance L3 for example is approximately 4 mm. This is controlled by engaging and disengaging the curling rollers 222, 224 only momentarily.

The sheet stripping device 230 in one embodiment as shown in FIG. 2 comprises a stripper finger 232 including a tip 233 that is located on the exit side of the fusing nip 75 between the surface 76 of the moving heated fusing member 72 and a curled away lead edge LE of the cut sheet 48 for easily stripping the cut sheet 48 from the surface 76. Advantageously, because of the away curl C3 in the leading edge LE, the tip 233 can be located spaced from or merely lightly against, the surface 76 in a manner so as not to damage the surface 76 but yet as not to interfere with the curled away lead edge LE.

Figure 3:
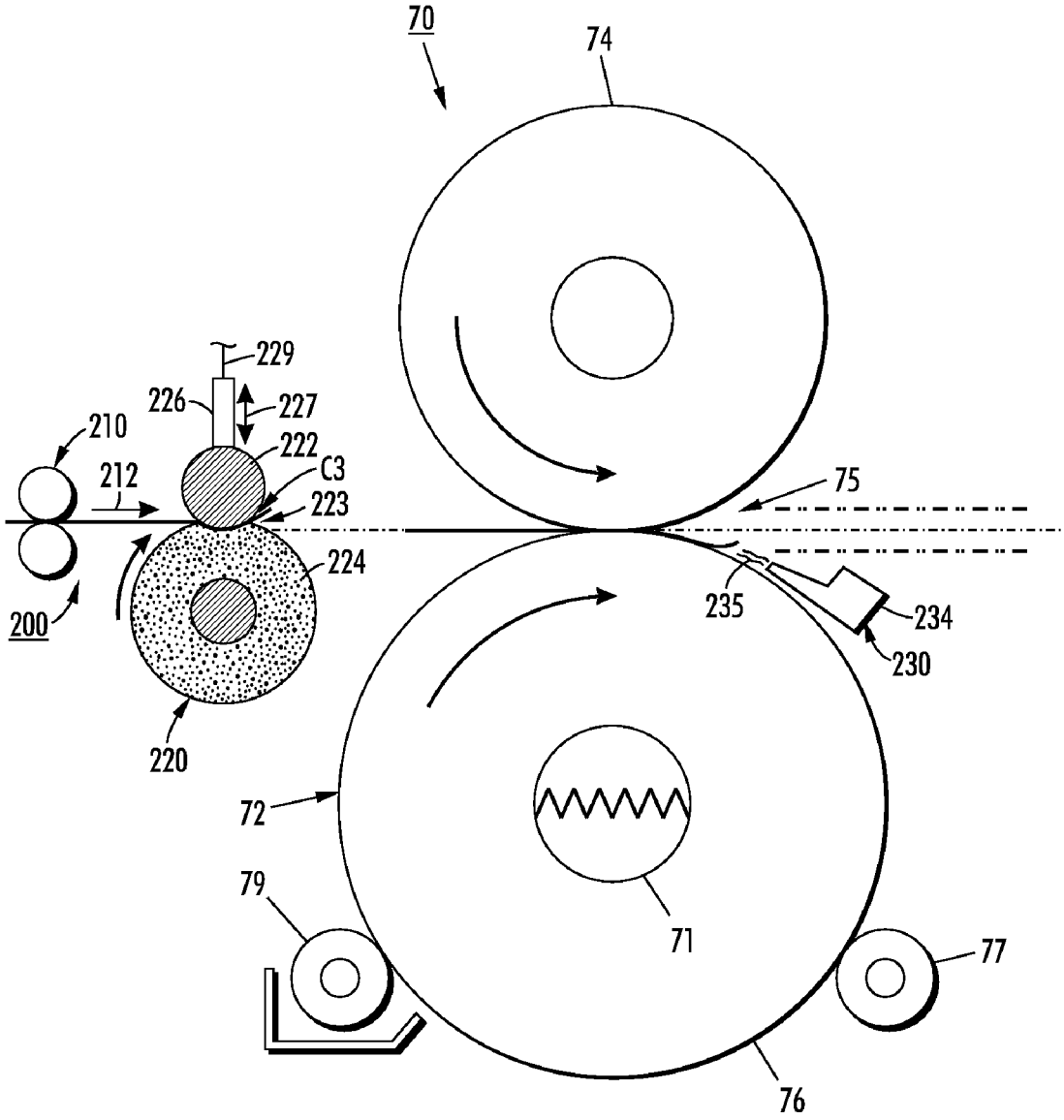
FIG. 3 is an enlarged end section schematic of the fusing apparatus of FIG. 1 showing a second embodiment of the enhanced sheet stripping apparatus in accordance with the present disclosure.

In another embodiment as shown in FIG. 3, the sheet stripping device 230 comprises an pressure device 234 for producing a relatively low pressure low volume air knife or stream 235 that is directed onto the surface 76 of the moving heated fusing member below a curled away lead edge LE of the cut sheet 48 for effectively stripping the cut sheet 48 from the surface 76 of the moving heated fusing member 72.

In general, the present disclosure is directed to a method and apparatus 200 for promoting robust or enhanced media stripping from a heated fusing member 72 such as a fuser roller or a transfix roller. The method involves inducing a slight radius (curl) C3 at the lead edge LE of a cut sheet 48 before it enters the fusing nip 75, resulting in a dramatically increased likelihood of the sheet exiting the fusing nip without a defect and without jamming. The induced curl C3 in the sheet is away 225 from the surface 76 fusing or transfix roller 72 thus enabling the lead edge LE to avoid direct contact with the tip 233 of a stripper finger 232 or blade upon exiting the fusing nip 75. Damage or jamming from such contact is thereby avoided.

The curl C3 is not meant to necessarily eliminate the need for a post fusing nip stripping device 230, but rather the curl C3 is meant to increase or enhance the stripping latitude of existing stripping devices. In accordance with the present disclosure, a standard decurler such as a hard roller 222 and soft roller 224 can be used for generating the desired curl or curvature C3. In one embodiment of the present disclosure, the curl C3 is generated only over a short distance L3 of approximately 4 mm into the sheet from the lead edge LE.

Figure 4:
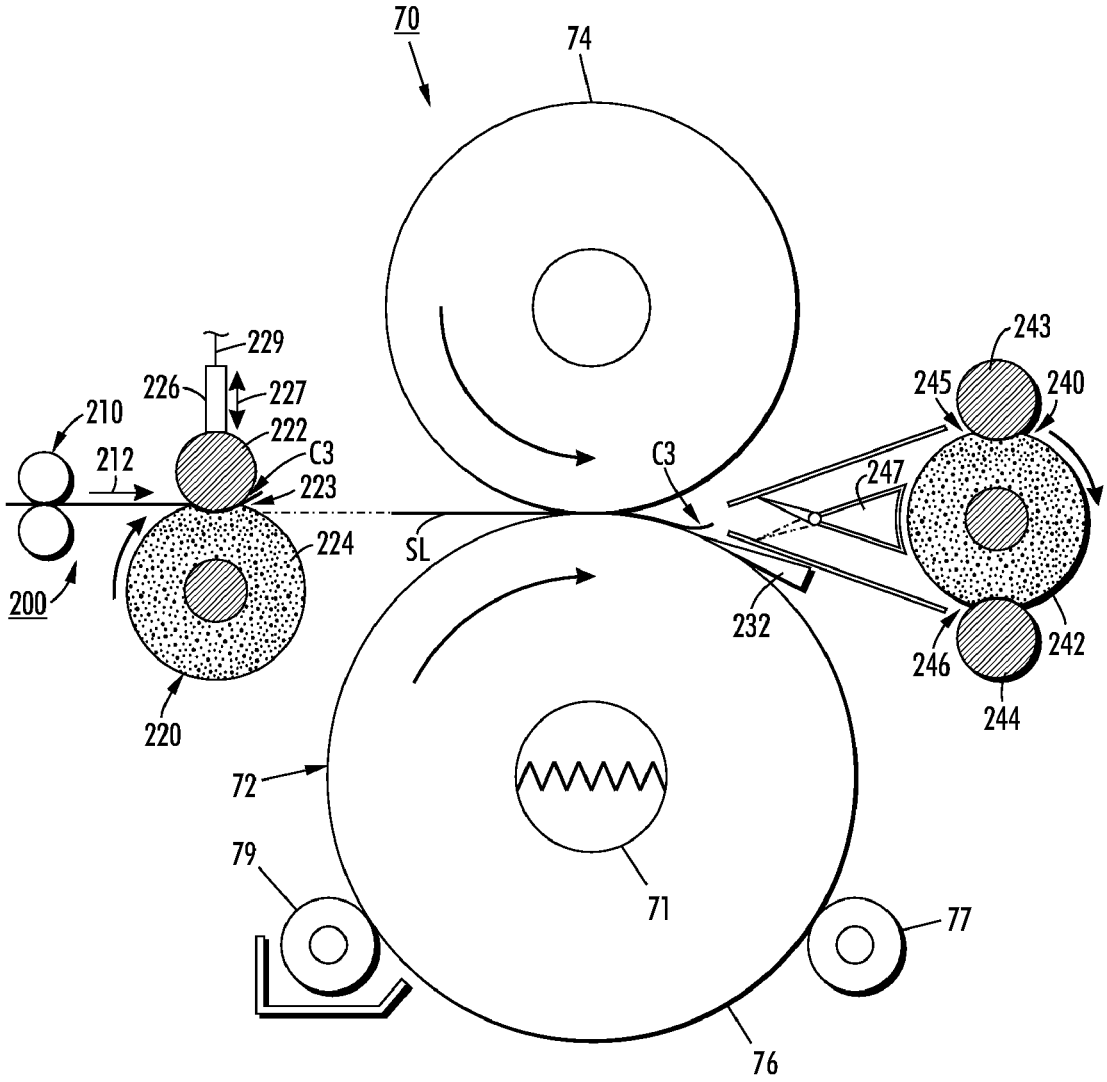
FIG. 4 is an enlarged end section schematic of the fusing apparatus of FIG. 1 showing a third embodiment of the enhanced sheet stripping apparatus in accordance with the present disclosure.

Although quantitative empirical and numerical data was developed suggesting that pre-curling of the media as per this disclosure does not significantly affect the post fusing sheet flatness, as shown in FIG. 4 a post fusing nip decurling device 240 may be provided for selectively removing any detected undesirable curl from the rest SL of the sheet. As shown, the decurling device 240 can comprise a soft central roller 242, a pair of hard rollers 243, 244 that form two decurling nips 245, 246 for removing opposite direction curls from SL, and a gating device 247 for directing a sheet from the fusing nip into either the top nip 245 or the bottom nip 246.

Figure 5:
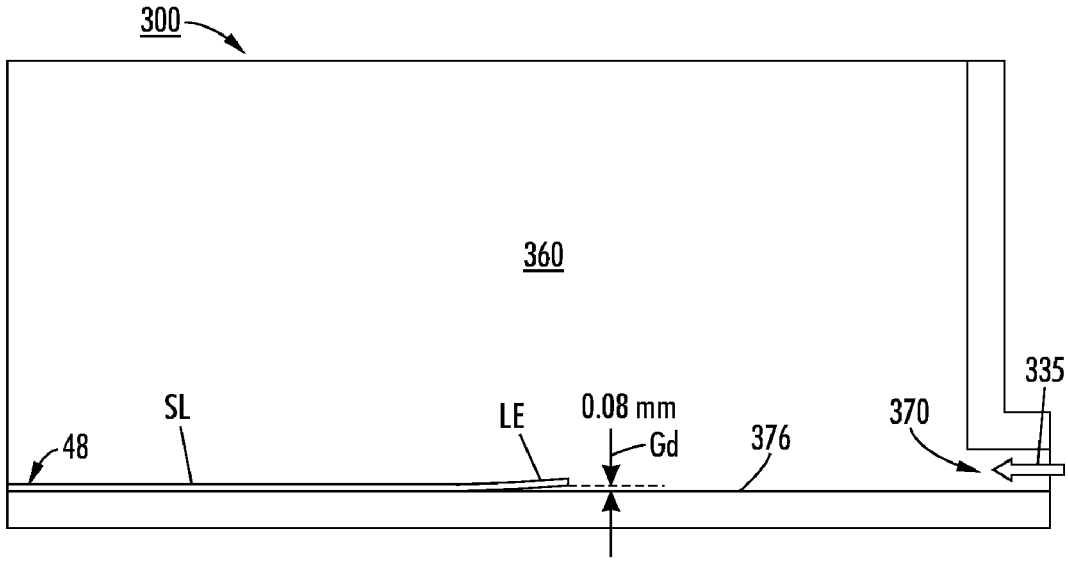
FIG. 5 PRIOR ART
FIG. 5 is a schematic illustration of air stripping in a prior art scenario.

FIG. 5 depicts a schematic of a prior art [no lead edge pre-curl condition] two-dimensional Fluent simulation in a chamber device 300 where an air knife 335 is used for stripping of a lead edge LE of a sheet of paper 48 from a platen surface 376 with a gap Gd of only about a 0.08 mm between the down surface or side Sd of the lead edge LE and the surface 376 because of the no pre-curl condition. As shown, the rest SL of the sheet of paper 48 is in contact with the platen surface 376 except for the lead edge LE which is raised by about 0.08 mm above the platen surface. The length or distance L3 of the raised portion of the lead edge segment is 4 mm or less. A compressed air stream or knife 335 at a pressure of 2 psig, and at an ambient temperature of 20 C, is introduced through a slot 370 into the chamber 360 of the device 300 as shown.

Figure 7:
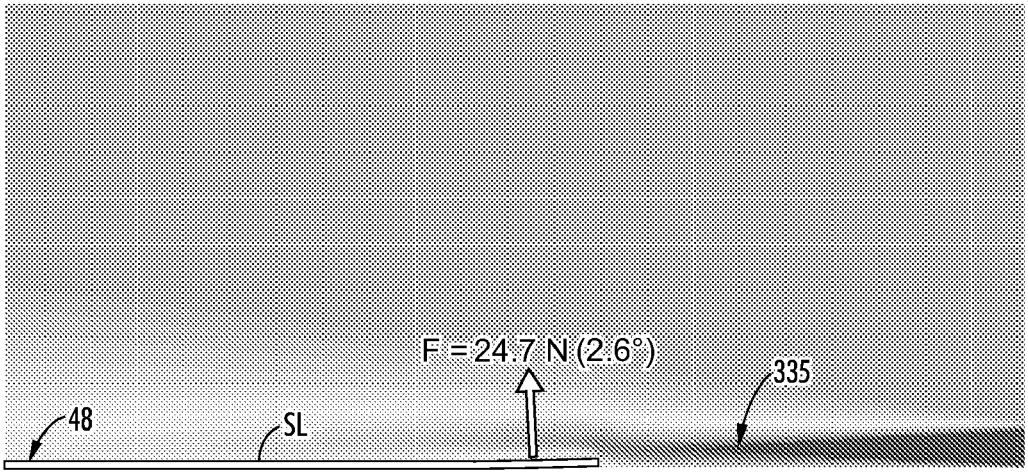
FIG. 7 PRIOR ART
FIG. 7 is a schematic illustration of a stripping force generated on the leading edge of a sheet during air stripping in a prior art scenario.

FIG. 7 is a schematic illustration of the stripping force F5 exerted on the lead edge LE by the air stream 335 under the conditions of FIG. 5. The stripping force F5 is calculated using a Fluent simulation program that solves for the detailed flow and pressure field within the chamber 360 as well as for the stripping force F5 exerted on the lead edge by the air stream 335 for the conditions of FIG. 5. As shown, the stripping force F5 on the side Sd of the lead edge facing the surface 376 is calculated to be 24.7 N (2.6°).

Figure 6:
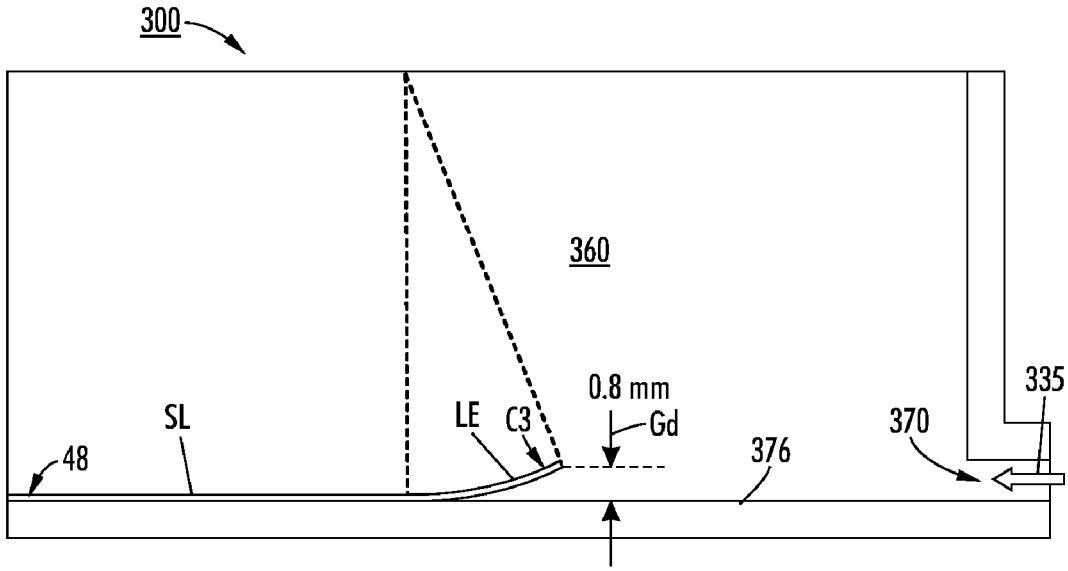
FIG. 6 is a schematic illustration of air stripping in accordance with the method of the present disclosure.

On the other hand, FIG. 6 depicts a schematic of a similar simulation as that of FIG. 5 but under pre-curl conditions of the present disclosure. As such, the lead edge LE is pre-curled with a curl C3 so as to present a 10 fold increase in the gap Gd" which is now 0.8 mm between the down side Sd of the lead edge and the platen surface 376. Everything else is otherwise the same, thus the rest SL of the sheet of paper 48 is in contact with the platen surface 376 except for the lead edge LE which is raised by about 0.08 mm above the platen surface. The length or distance L3 of the raised portion of the lead edge segment is 4 mm or less. A compressed air stream or knife 335 at a pressure of 2 psig, and at an ambient temperature of 20 C, is introduced through a slot 370 into the chamber 360 of the device 300 as shown.

Figure 8:
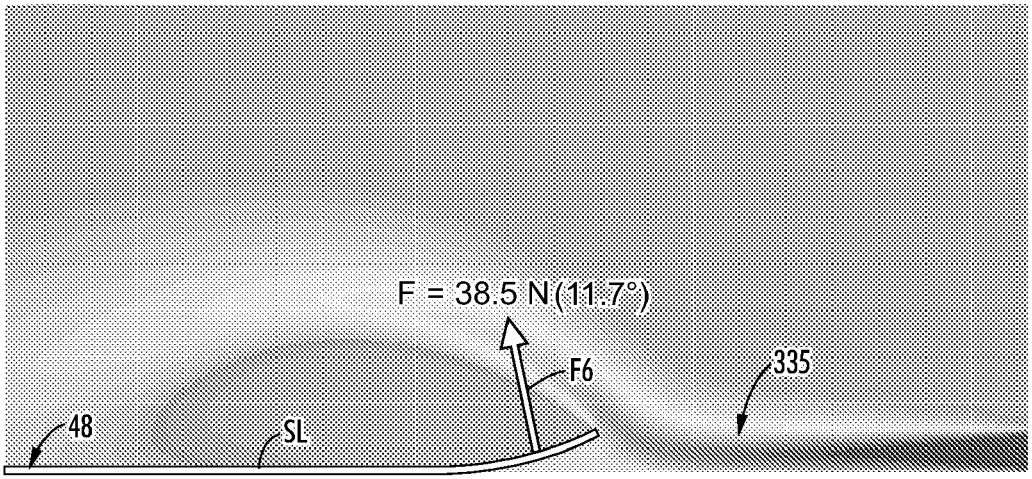
FIG. 8 is a schematic illustration of a stripping force generated on the leading edge of a sheet during sheet stripping in accordance with the method of the present disclosure.

FIG. 8 is a schematic illustration of the stripping force F6 exerted on the lead edge LE by the air stream 335 under the conditions of FIG. 6. The stripping force F6 is again calculated using the Fluent simulation program that solves for the detailed flow and pressure field within the chamber 360 as well as for the stripping force F6 exerted on the lead edge by the air stream 335 for the conditions of FIG. 6. As shown, the stripping force F6 on the side Sd of the lead edge facing the surface 376 is calculated now to be significantly greater at 38.5 N (11.7°).

A direct comparison between the results of these simulations of FIGS. 5 and 6 as shown in FIGS. 7 and 8, clearly allows us to assess and quantify the improvement in stripping force F5, F6 when the lead edge LE is pre-curled with an away curl C3. In FIG. 7, the conventional resultant force F5 (magnitude and direction) acting on the lead edge LE is calculated and shown as the difference in pressure between the inner or down side Sd (towards the platen 376) and outer or opposite side Su of the lead edge LE. The same is done in the case of FIG. 8.

As can clearly be seen, the pre-curl resultant force F6 at 38.5 N is more than 50% greater than the conventional resultant force F5 at 24.6 N. This is because in FIG. 6, more of the air stream 335 entered or got between the inner side Sd and the platen 376 due to leading edge pre-curl C3, and so produced the greater lifting force F6.

As can be seen, there has been provided an enhanced sheet stripping method and apparatus for stripping toner image carrying copy sheets from a surface of a moving heated fusing member forming a fusing nip. The apparatus includes (a) a moving assembly for moving a cut sheet towards the fusing nip; (b) a sheet curling device positioned upstream of the fusing nip relative to movement of the cut sheet for inducing a desired pre-curl in the cut sheet before the cut sheet enters the fusing nip; and (c) a sheet stripping device positioned downstream of the fusing nip for stripping the cut sheet from contact with the surface of the moving heated fusing member as the cut sheet exits the fusing nip. The method includes inducing a desired curl in the cut sheet before the cut sheet enters the fusing nip and enhanced stripping the cut sheet from contact with the surface of the fuser roll as the cut sheet exits the fusing nip.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of enhancing cut sheet stripping from a surface of a first roll, the first roll being heated and the first roll forming a sheet processing nip with a second roll, the method comprising:
   - moving a cut sheet towards the sheet processing nip;
   - inducing a desired curl in the cut sheet before the cut sheet enters the sheet processing nip;
   - nip feeding the cut sheet having the desired curl through the sheet processing nip so that the cut sheet is in contact with the surface of the first roll; and
   - stripping with a stripping device the cut sheet from contact with the surface of the heated first roll as the cut sheet exits the sheet processing nip, the cut sheet having the desired curl as the cut sheet exits the nip.

2. A method of enhancing cut sheet stripping from a surface of a fuser roll, the fuser roll forming a fusing nip with a fusing member, the method comprising:
   - moving a cut sheet towards the fusing nip;
   - inducing a desired curl in the cut sheet before the cut sheet enters the fusing nip;
   - nip feeding the cut sheet having the desired curl through the fusing nip so that the cut sheet is in contact with the surface of the fuser roll; and
   - stripping the cut sheet from contact with the surface of the fuser roll as the cut sheet having the induced curl exits the fusing nip.

3. The method of claim 2, wherein inducing a desired curl comprises
   - inducing into the cut sheet a curl tending away from the surface of the fuser roll, wherein the curl remains in the cut sheet after the cut sheet passes through the processing nip.

4. The method of claim 3, wherein inducing a desired curl comprises inducing the curl starting from a lead edge of the cut sheet and extending a relatively short distance only into the cut sheet.

5. The method of claim 4, wherein inducing a desired curl comprises inducing the curl away from the surface of the fuser roll starting from a lead edge of the cut sheet and only over a partial distance of approximately 4 mm into the cut sheet.

6. The method of claim 2, wherein stripping the cut sheet comprises placing a stripper finger between the surface of the fuser roll and a curled away lead edge of the cut sheet, in a manner not to damage the surface of the fuser roll and not to interfere with the curled away lead edge, for effectively stripping the cut sheet from the surface of the fuser roll.

7. The method of claim 2, wherein stripping the cut sheet comprises applying a low pressure low volume air knife onto the surface of the fuser roll and interposing the surface of the fuser roll and a curled away lead edge of the cut sheet for effectively stripping the cut sheet from the surface of the fuser roll.

8. An enhanced sheet stripping apparatus for stripping toner image carrying copy sheets from a surface of a moving heated fusing member forming a fusing nip, the enhanced sheet stripping apparatus comprising:

(a) moving means for moving a cut sheet towards the fusing nip;

(b) a sheet curling device positioned upstream of the fusing nip relative to movement of the cut sheet that induces a desired pre-curl in the cut sheet before the cut sheet enters the fusing nip; and (c) a sheet stripping device positioned downstream of the fusing nip that strips the cut sheet having the induced pre-curl from contact with the surface of the moving heated fusing member as the cut sheet exits the fusing nip.

9. The enhanced sheet stripping apparatus of claim 8, wherein the sheet curling device includes means for inducing into the cut sheet a curl tending away from the surface of the moving heated fusing member, the cut sheet having the induced pre-curl after the cut sheet exits the fusing nip.

10. The enhanced sheet stripping apparatus of claim 9, wherein the sheet curling device includes control means for inducing the curl starting from a lead edge of the cut sheet and extending a relatively short distance only into the cut sheet.

11. The enhanced sheet stripping apparatus of claim 10, wherein the relatively short distance is approximately 4 mm.

12. The enhanced sheet stripping apparatus of claim 8, wherein the sheet stripping device comprises a stripper finger including a tip located between the surface of the moving heated fusing member and a curled away lead edge of the cut sheet for easily stripping the cut sheet therefrom in a manner not to damage the surface of the moving heated fusing member and not to interfere with the curled away lead edge.

13. The enhanced sheet stripping apparatus of claim 8, wherein the sheet stripping device comprises a relatively low pressure low volume air knife being directed onto the surface of the moving heated fusing member below a curled away lead edge of the cut sheet for effectively stripping the cut sheet from the surface of the moving heated fusing member.

14. An electrostatographic reproduction machine comprising:

(a) a moveable imaging member including an imaging surface;

(b) imaging means for forming and transferring a toner image onto a toner image carrying sheet; and (c) an enhanced sheet stripping apparatus for stripping toner image carrying copy sheets from a surface of a moving heated fusing member forming a fusing nip, the enhanced sheet stripping apparatus including:

(i) moving means for moving a cut sheet towards the fusing nip;

(ii) a sheet curling device positioned upstream of the fusing nip relative to movement of the cut sheet that induces a desired pre-curl in the cut sheet before the cut sheet enters the fusing nip; and (iii) a sheet stripping device positioned downstream of the fusing nip that strips the cut sheet from contact with the surface of the moving heated fusing member as the cut sheet having the induced pre-curl exits the fusing nip.

15. The electrostatographic reproduction machine of claim 14, wherein the sheet curling device includes means for inducing into the cut sheet a curl tending away from the surface of the moving heated fusing member.

16. The electrostatographic reproduction machine of claim 15, wherein the sheet curling device includes control means for inducing the curl starting from a lead edge of the cut sheet and extending a relatively short distance only into the cut sheet.

17. The electrostatographic reproduction machine of claim 16, wherein the relatively short distance is approximately 4 mm.

18. The electrostatographic reproduction machine of claim 16, including a sheet decurling device positioned downstream of the fusing nip relative to movement of the cut sheet for removing any undesired curl from the cut sheet after the cut sheet exits the fusing nip.

19. The electrostatographic reproduction machine of claim 14, wherein the sheet stripping device comprises a stripper finger including a tip located between the surface of the moving heated fusing member and a curled away lead edge of the cut sheet for easily stripping the cut sheet therefrom in a manner not to damage the surface of the moving heated fusing member and not to interfere with the curled away lead edge.

20. The electrostatographic reproduction machine of claim 14, wherein the sheet stripping device comprises a low pressure low volume air knife being directed onto the surface of the moving heated fusing member below a curled away lead edge of the cut sheet for effectively stripping the cut sheet from the surface of the moving heated fusing member.

* * * * *